US009291170B2

(12) United States Patent
Heymann

(10) Patent No.: US 9,291,170 B2
(45) Date of Patent: Mar. 22, 2016

(54) BLOWER ASSEMBLY FOR ELECTRONIC DEVICE

(71) Applicant: Intel Corporation, Santa Clara, CA (US)

(72) Inventor: Douglas Heymann, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 417 days.

(21) Appl. No.: 13/930,204

(22) Filed: Jun. 28, 2013

(65) Prior Publication Data

US 2015/0003974 A1 Jan. 1, 2015

(51) Int. Cl.

| | |
|---|---|
| ***F04D 29/44*** | (2006.01) |
| ***F04D 29/42*** | (2006.01) |
| ***F04D 29/28*** | (2006.01) |
| ***F04D 5/00*** | (2006.01) |

(52) U.S. Cl.

CPC ..... *F04D 29/4226* (2013.01); *F04D 5/00* (2013.01); *F04D 29/282* (2013.01); *F04D 29/441* (2013.01)

(58) Field of Classification Search

CPC ..... F04D 5/00; F04D 29/282; F04D 29/4226; F04D 29/422; F04D 29/441

See application file for complete search history.

(56) References Cited

U.S. PATENT DOCUMENTS

| | | | | |
|---|---|---|---|---|
| 5,879,141 | A | 3/1999 | Yokozawa et al. | |
| 6,111,748 | A * | 8/2000 | Bhatia | F04D 17/04 165/122 |
| 6,698,505 | B2 * | 3/2004 | Lopatinsky | F04D 17/04 165/122 |
| 6,903,928 | B2 * | 6/2005 | Lopatinsky | F04D 17/04 165/121 |
| 6,981,542 | B2 | 1/2006 | Lopatinsky et al. | |
| 7,021,894 | B2 | 4/2006 | Lopatinsky et al. | |
| 7,071,587 | B2 * | 7/2006 | Lopatinsky | F04D 17/04 257/E23.099 |
| 2004/0245866 | A1 | 12/2004 | Lopatinsky et al. | |
| 2005/0019155 | A1 | 1/2005 | Lasko | |
| 2006/0078423 | A1 | 4/2006 | Zheng | |
| 2010/0172095 | A1 | 7/2010 | MacDonald et al. | |
| 2012/0026677 | A1 | 2/2012 | Bhutani | |
| 2013/0164158 | A1 | 6/2013 | Matsuba et al. | |

FOREIGN PATENT DOCUMENTS

| | | |
|---|---|---|
| CN | 202360431 U | 8/2012 |
| TW | 505376 U | 10/2002 |

OTHER PUBLICATIONS

International Search Report received for PCT Application No. PCT/US2014/043760 mailed on Oct. 16, 2014, 4 pages.

Office Action and Search Report received for Taiwanese Patent application No. 103119399, mailed on Nov. 19, 2015, 8 pp. including 1 page of English translation.

* cited by examiner

*Primary Examiner* — Ninh H Nguyen

(74) *Attorney, Agent, or Firm* — Alpine Technology Law Group LLC

(57) ABSTRACT

In one embodiment a blower comprises a case comprising a first surface, a second surface opposite the first surface, and a side wall extending between portions of the first surface and the second surface, wherein the side wall comprises an air inlet and an air outlet, an impeller disposed in the case and rotatable about an axis of rotation extending through a hub, wherein the impeller comprises a plurality of blades which define a gap with the hub, wherein portions of the side wall are disposed at least a first distance from the axis of rotation and the impeller is to define a circumferential airflow path within the case, wherein the impeller is to create an airflow in the circumferential airflow path between the air inlet and the air outlet, and a feature disposed in the gap to impede recirculation of air in the case.

21 Claims, 11 Drawing Sheets

BLOWER ASSEMBLY FOR ELECTRONIC DEVICE

RELATED APPLICATIONS

None.

BACKGROUND

The subject matter described herein relates generally to the field of electronic devices and more particularly to a blower assembly for one or more electronic devices.

Modern computing systems generate heat during operation. The heat may affect certain platform components of a system, and is therefore generally required to be dissipated or removed from the system. Heat generated by the computing system may be limited or reduced using various thermal management techniques and/or heat dissipation techniques. For example, heat generated by a processor may be dissipated by creating a flow of air using a fan or blower. Further, various platform-level cooling devices may be implemented in conjunction with the fan or blower to enhance heat dissipation, such as heat pipes, heat spreaders, heat sinks, vents, phase change materials or liquid-based coolants.

Traditional blowers used in portable computing systems generate a flow of air from an inlet parallel to the axis of rotation (e.g. the axial direction) to an outlet substantially perpendicular to the axis of rotation. This may be problematic in notebook computers, for example, because these traditional fans require inlet gaps above and/or below the fan housing. Because of the size constraints of a notebook computer, the cooling capacity of traditional systems is thermally limited by the size of fan that can be accommodated inside a notebook computer housing while allowing sufficient space for inlet gaps above and/or below the fan housing. Furthermore, the form factor of notebook computers continues to decrease in size, resulting in less available space for cooling components. Consequently, a need exists for improved cooling techniques for notebook computers.

BRIEF DESCRIPTION OF THE DRAWINGS

The detailed description is described with reference to the accompanying figures.

DETAILED DESCRIPTION

Described herein are exemplary embodiments of a blower assembly for an electronic devices. In the following description, numerous specific details are set forth to provide a thorough understanding of various embodiments. However, it will be understood by those skilled in the art that the various embodiments may be practiced without the specific details. In other instances, well-known methods, procedures, components, and circuits have not been illustrated or described in detail so as not to obscure the particular embodiments.

Figure 1:
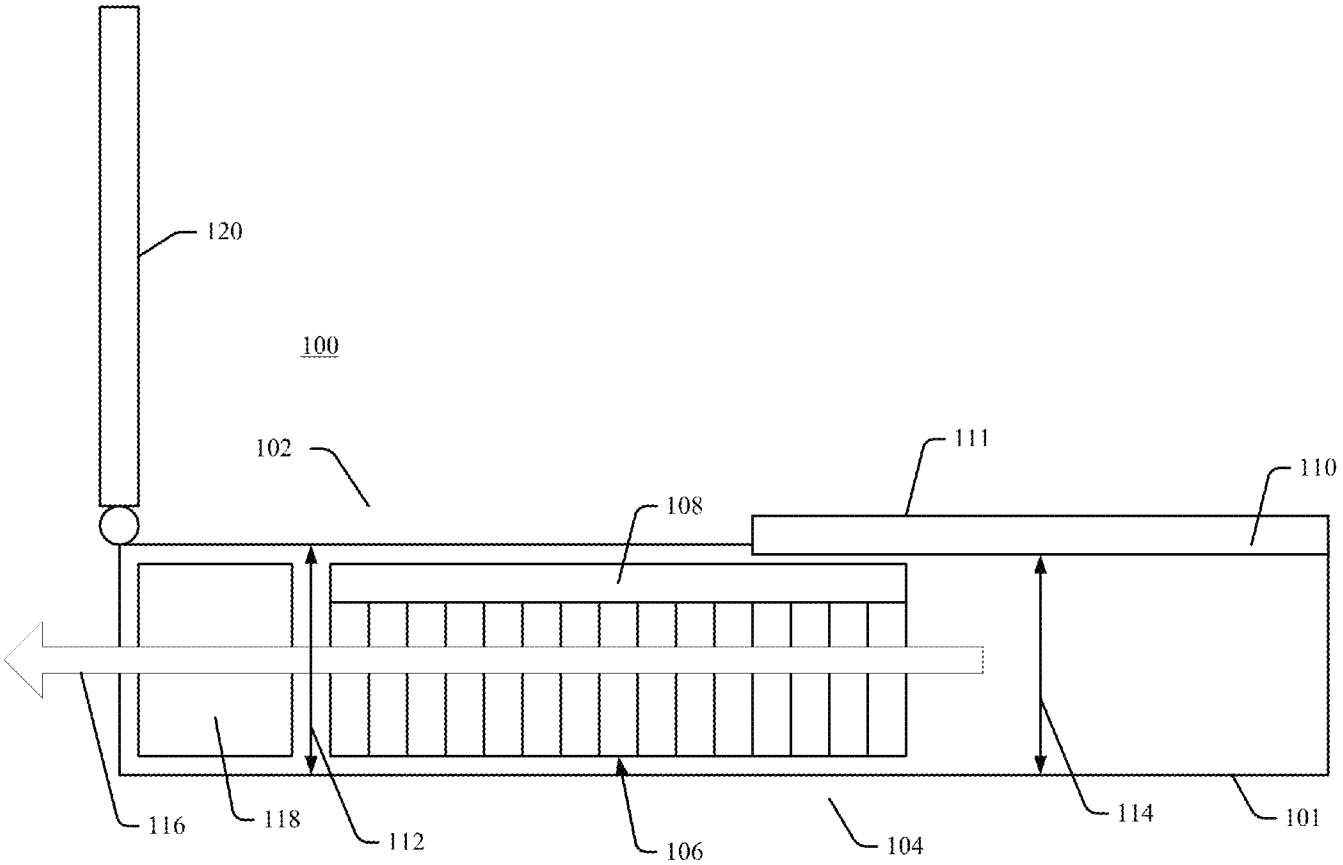
FIG. 1 is a schematic illustration of an electronic device which may be modified to include an blower assembly in accordance with some embodiments.

FIG. 1 is a schematic illustration of an electronic device 100 which may be modified to include a blower assembly in accordance with some embodiments. Electronic device 100 may comprise an ultrathin notebook computer having an internal housing height of 8.0 mm or less in some embodiments. As shown in FIG. 1, electronic device 100 comprises multiple elements, such a housing 101, a blower 106, motor 108, keyboard 111, a heat dissipation component 118, e.g., a heat sink and display 120. The embodiments of electronic device 100, however, are not limited to the elements shown in this figure.

In various embodiments, blower 106 may comprise a fan or blower arranged to create a side-in, side-out flow of air through the blower in a direction perpendicular to the axis of rotation of the blower. Other embodiments are described and claimed.

Motor 108 may comprise any suitable electric motor capable of rotating side-in, side-out blower 106 to create a flow of air in some embodiments. In various embodiments, motor 108 may comprise an AC motor, brushed DC motor or brushless DC motor. For example, motor 108 may comprise a DC motor powered by an internal or external power source of apparatus 100. In some embodiments, motor 108 may comprise a tip-drive motor or an ultrathin motor. The size, location within housing 101, and location with respect to side-in, side-out blower 106 may be selected based on the size and performance constraints of a particular implementation.

In various embodiments, housing 101 may include a first section 102 and a second section 104. In some embodiments, a portion of the first section 102 may be recessed in a direction of the second section 104. The recessed portion 110 of the housing 101 may be configured to accommodate a keyboard assembly such as keyboard 111 such that the keys of keyboard 111 may be depressed below a top surface of the first side 102 of the housing 101. The housing may have a first internal height 112 between the first section 102 and the second section 104 and a second internal height 114 between the recessed portion 110 of the first section 102 and the second side section.

In some embodiments, a portion of the blower 106 may be positioned between the recessed portion 110 of the first section 102 and the second section 104. In this configuration, for example, the blower 106 may have an axial height that is approximately equal to the second internal height 114. Other heights may be used and still fall within the described embodiments. Furthermore, it should be understood that adequate space between the blower 106 and the internal surfaces of the housing 101 should be provided such that the blower 106 does not contact the internal surfaces of the housing 101 when it is operated. In various embodiments the surface features of the areas surrounding the blower 106 may be configured to minimize leakage and minimize drag on the blower 106.

A motor 108 may be positioned above or below the blower 106, for example. In various embodiments, the motor 108 may be positioned between the blower 106 and the first side 102. In some embodiments, the motor 108 may have a height that is approximately equal to a difference between the first internal height 112 and the second internal height 114 or a difference between the first internal height 112 and the axial height of the blower 106. In this manner, the total internal height (e.g. height 112) may be fully utilized by the combination of blower 106 and motor 108.

In some embodiments, motor 108 may be positioned centrally above the axis of blower 106 and may control or spin the blower 106 to generate a flow of air 116. Furthermore, the motor 108 may be located between keyboard 111 and display 120, which may be coupled to housing 101 such that the display 120 may be rotated with respect to the housing 101, in some embodiments. In various embodiments, a heat dissipation component 118 or other heat dissipation component may be located downstream from the blower 106 to assist with heat dissipation for the electronic device 100.

Figure 2A:
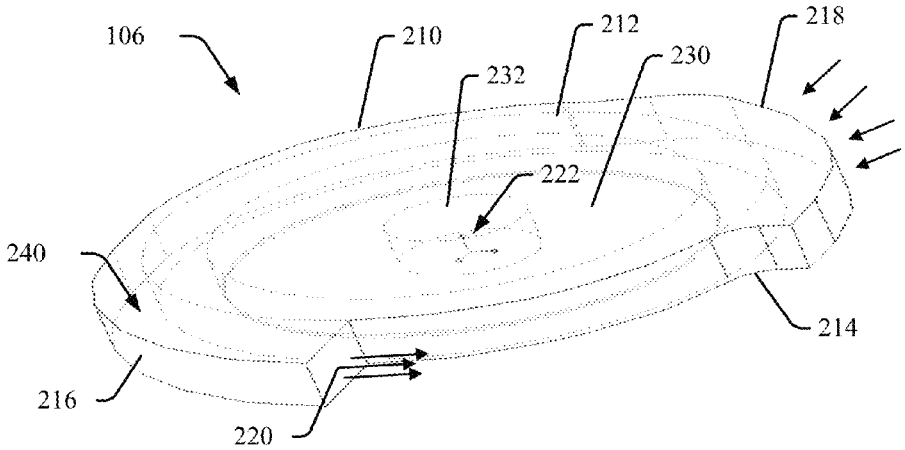
FIG. 2A is a schematic, perspective view illustration of a blower in accordance with some embodiments.

Aspects of a blower 106 will be explained with reference to FIGS. 2A and 2B. Referring first to FIG. 2A in some embodiments a blower 106 comprises a case 210 comprising a first surface 212, a second surface 214 opposite the first surface 210, and a side wall 216 extending between portions of the first surface 212 and the second surface 214. In some embodiments the side wall 216 comprises an air inlet 218 and an air outlet 220. In some embodiments the air inlet 218 may be substantially larger than the air outlet 220.

In some embodiments an impeller 230 is disposed in the case 210 and rotatable about a central axis 222 extending between the first surface 210 and the second surface 212. A conventional Cartesian coordinate system 222 may be overlaid on the hub 232 of the impeller, and in such a coordinate system the impeller may be rotatable in the (x,y) plane and about the z axis.

Figure 2B:
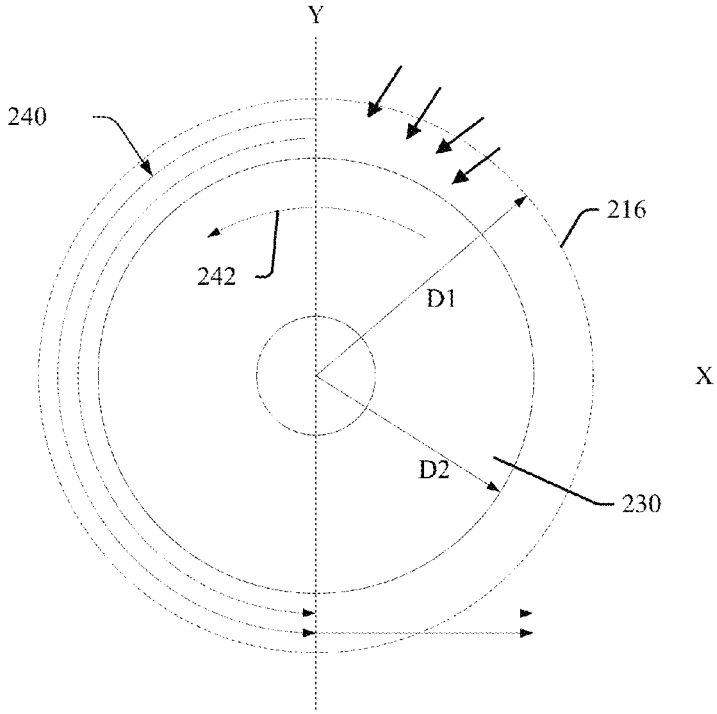
FIG. 2B is a schematic, perspective plan illustration of portions of a blower in accordance with some embodiments.

In some embodiments portions of the side wall 216 are disposed at a first distance, indicated by D1 on FIG. 2B, from the central axis and the impeller 230 has a second distance, indicted by D2 on FIG. 2B, less than the first radius R1, from the central axis. In such embodiments the impeller 230 defines a circumferential airflow path 240 within the case 210. In some embodiments the first radius R1 measures at least 10 millimeters greater than the second radius R2. In operation, the impeller 230 rotates about the central axis in the (x,y) plane to create an airflow in the circumferential airflow path 240 between air inlet 218 and the air outlet 220.

In some embodiments the impeller 230 is substantially centrally located within the case 210. The central axis about which the impeller 230 rotates lies within a plane perpendicular to the plane of rotation of the impeller 230, and the air outlet 220 is disposed in a second plane, substantially perpendicular to the plane in which the impeller 230 rotates. Further, in some embodiments the air outlet 220 is disposed within approximately 5 millimeters of the plane perpendicular to the plane of rotation of the impeller which includes the central axis, represented by the Y axis on FIG. 2B.

In some embodiments, impeller 230 may comprise a rotor configured to increase the pressure and/or flow of air in some embodiments. The rotor may be centrally located within the case 210. The blades of the impeller 230 may be any size, shape, number or configuration suitable for inducing the circumferential flow of air. In some embodiments, the plurality of blades of impeller 230 may be spaced unevenly to improve the acoustic characteristics of blower 106. In various embodiments, the number of blades may be selected to reduce resonant acoustic noise created by the blower 106 in a predefined frequency range or feathering or notching of the blades of the impeller 230 may be utilized to reduce coherent noise production. In some embodiments the blades may be constructed from a foam material, while in other embodiments the blades may be formed from a rigid material, e.g., a suitable plastic or metal. Furthermore, passive or active noise cancellation components may optionally be included along with a blower system to reduce resonant noise generated by the impeller 230 in some embodiments. Other embodiments are described and claimed.

In operation, when motor 108 is activated it drives impeller 230, causing impeller 230 to rotate in the direction indicated by arrow 242. Rotation of the impeller 230 generates an airflow through air inlet 218, through circumferential airflow path 240 and out the air outlet 220, as indicated in FIGS. 2A and 2B.

In some embodiments the motor 108 may be positioned within the blower case 210. By way of example, the motor 108 may be positioned within a radius of the impeller 230 of the blower 106. For example, a portion or the entire radius of the motor 108 may overlap with a portion or the entire radius of the impeller 230 of blower 106. In this arrangement, the combined height of the motor 108 and the blower 106 may be approximately equal to an internal height of an enclosure for the apparatus, such as height 114 of enclosure 101 of FIG. 1. In some embodiments, motor 106 may be located entirely inside the radius of rotor 230 such that motor 106 does not overlap with the blades of rotor 230 to reduce the possibility of mechanical interference between the motor 108 and the blades of rotor 230.

The above described embodiments may be used to improve airflow in ultrathin notebooks having internal heights (e.g. first internal height 112 of FIG. 1) of 8.0 mm or less. In some embodiments, an internal height of 8.0 mm may correspond to a notebook having an exterior thickness of 0.5-0.8 inches, for example.

Figure 3A:
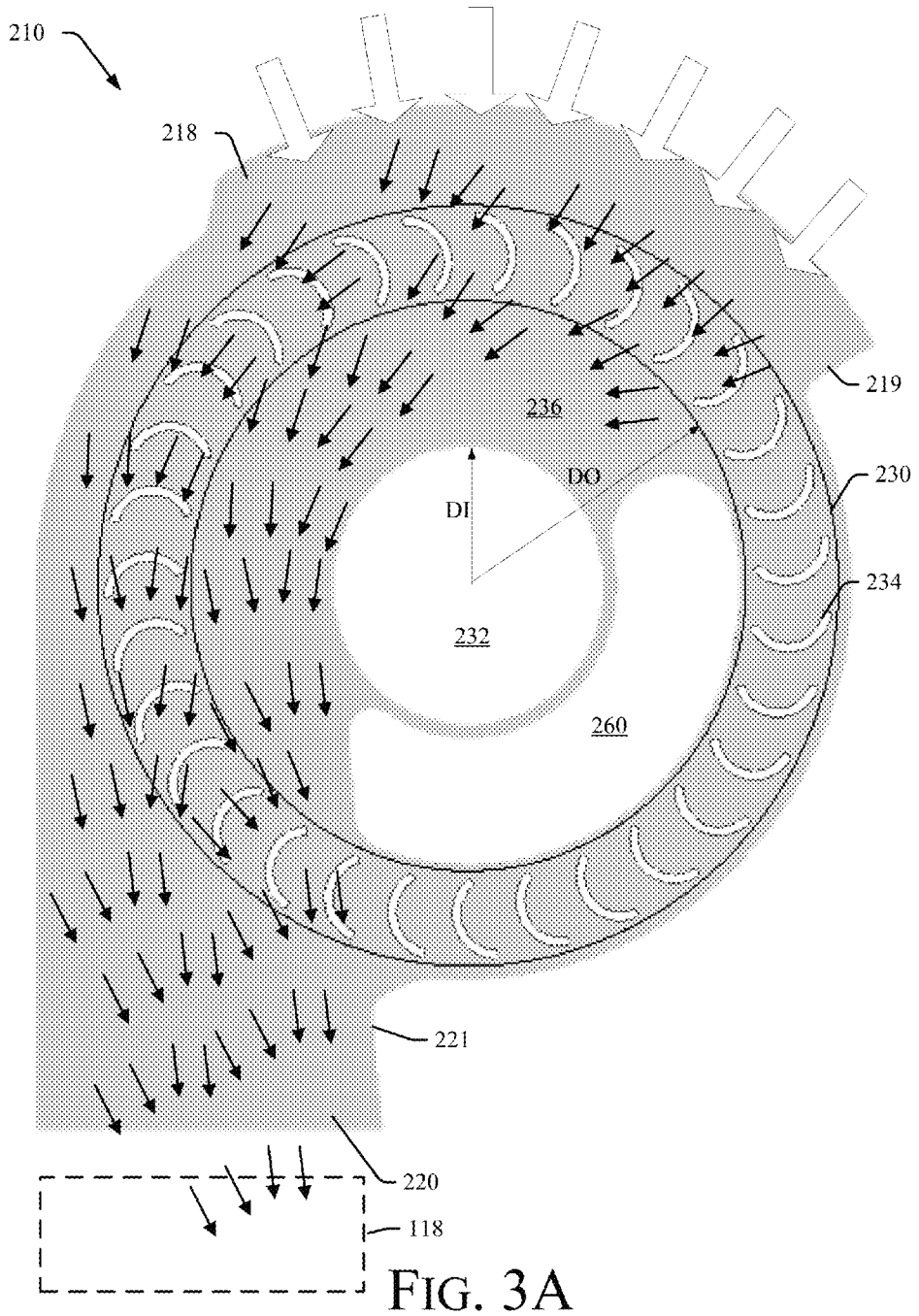
FIGS. 3A-3B are top view illustrations of a blower in accordance with some embodiments.
Figure 3B:
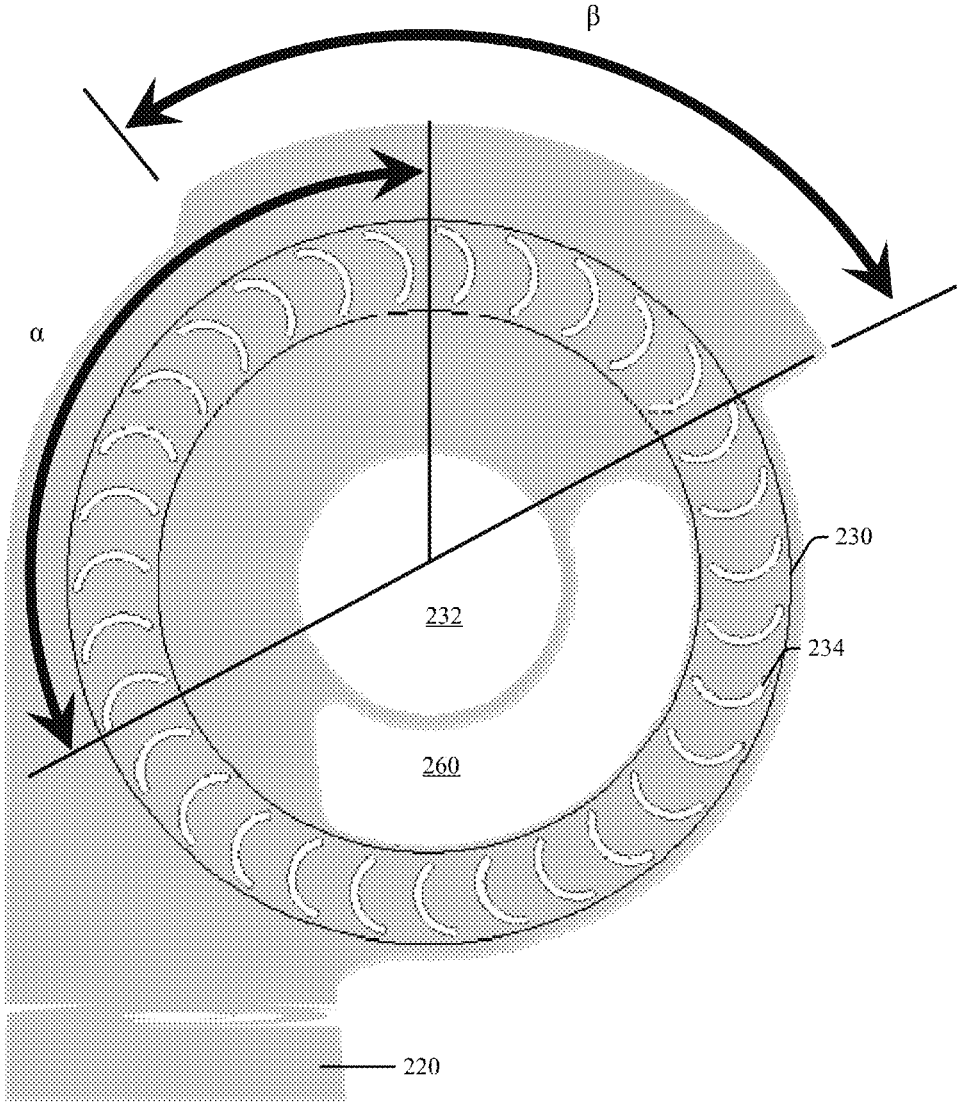

FIGS. 3A-3B are top view illustrations of a blower in accordance with some embodiments. Referring to FIGS. 3A-3B, in some embodiments the impeller 230 comprises a plurality of blades 230 which define a gap 236 with the hub, and a feature 260 may be disposed within the gap 236 to impede recirculation of air in the case 210.

In the example depicted in FIG. 3A the gap 236 has an inner diameter indicated by reference D1 that corresponds to the outer diameter of hub 232 and an outer diameter indicated by reference D2 that corresponds to the inner diameter of impeller 230. In some embodiments the inner diameter DI measures between 38 millimeters and 55 millimeters from the axis of rotation and the outer diameter D2 measures between 45 millimeters and 60 millimeters from the axis of rotation.

As illustrated in FIG. 3A, in some embodiments the feature 260 comprises an arcuate member disposed within portions of the gap 236. More particularly, in the embodiment depicted in FIGS. 3A-3B the feature 260 may extend from a location approximately corresponding to an inner edge 221 of the air outlet 220 to a location approximately corresponding to an inner edge 219 of the air inlet 218. The feature 260 may be formed integrally with at least one of the first surface 212 or the second surface 214. For example, the feature 260 may be defined by walls depending from at least one of the first surface 212 or the second surface 214.

In operation, rotation of the impeller 230 about the hub in a counter-clockwise direction draws air into the air inlet 218 and creates a circumferential airflow path between the air inlet 218 and the air outlet 220, as indicated by the arrows in FIG. 3A. A portion of the airflow passes through the gap 236 in the region between the air inlet 218 and the air outlet 220 and exits to pass the heat dissipation component 118. The feature 260 impedes recirculation of the air in the case 210, thereby increasing the efficiency of the blower 210.

FIG. 3B illustrates various aspects of a blower 210, according to some embodiments. Referring to FIG. 3B, in some embodiments a blower 210 includes an inlet angle indicated by the symbol $\alpha$ which measures between 90 degrees and 120 degrees and an inlet span angle indicated by the symbol $\beta$ which measures between 50 degrees and 90 degrees.

Figure 4A:
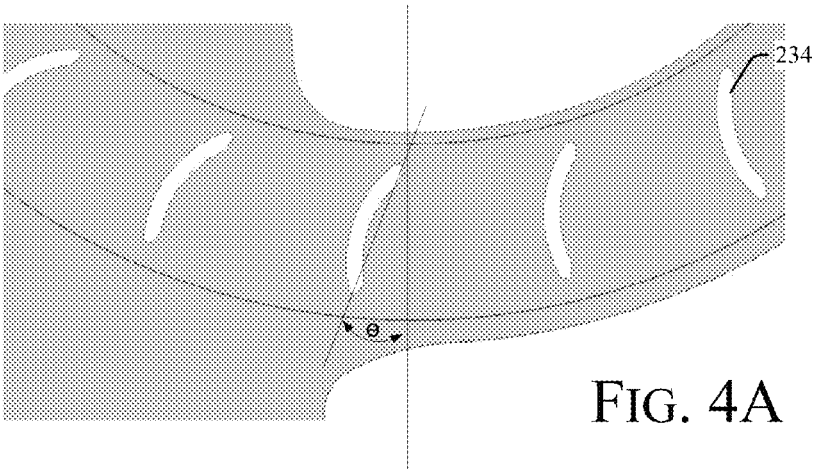
FIGS. 4A-4C are top view illustrations of impeller blades for a blower in accordance with some embodiments.
Figure 4B:
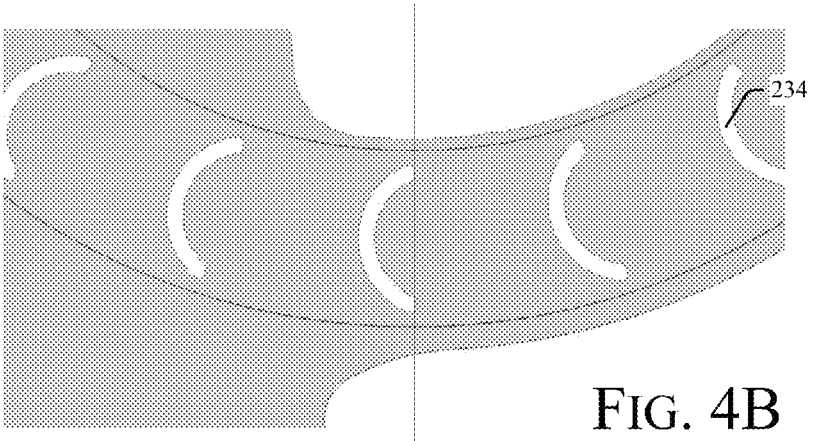
Figure 4C:
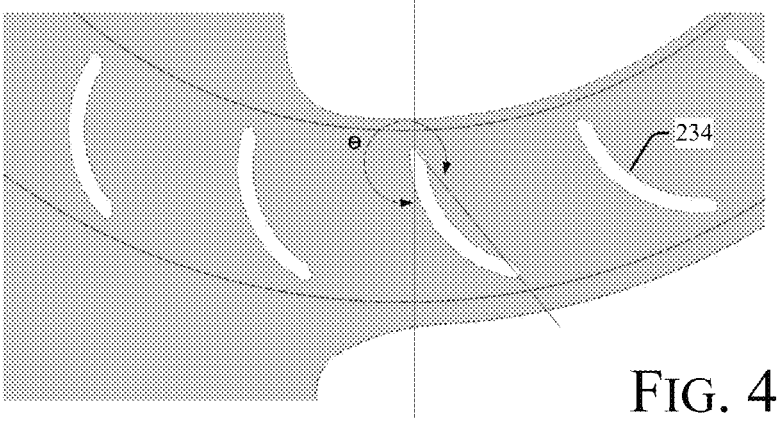

FIGS. 4A-4C are top view illustrations of impeller blades 234 for a blower 210 in accordance with some embodiments. Referring to FIGS. 4A-4C, in some embodiments the blades 234 may be constructed with a radius of curvature that may vary between 1 millimeters (FIG. 4A) and 4 millimeters (FIG. 4B). In addition, the blades 234 may be oriented on the impeller 230 to define a blade angle θ that varies between 340 degrees and 20 degrees.

Figure 5:
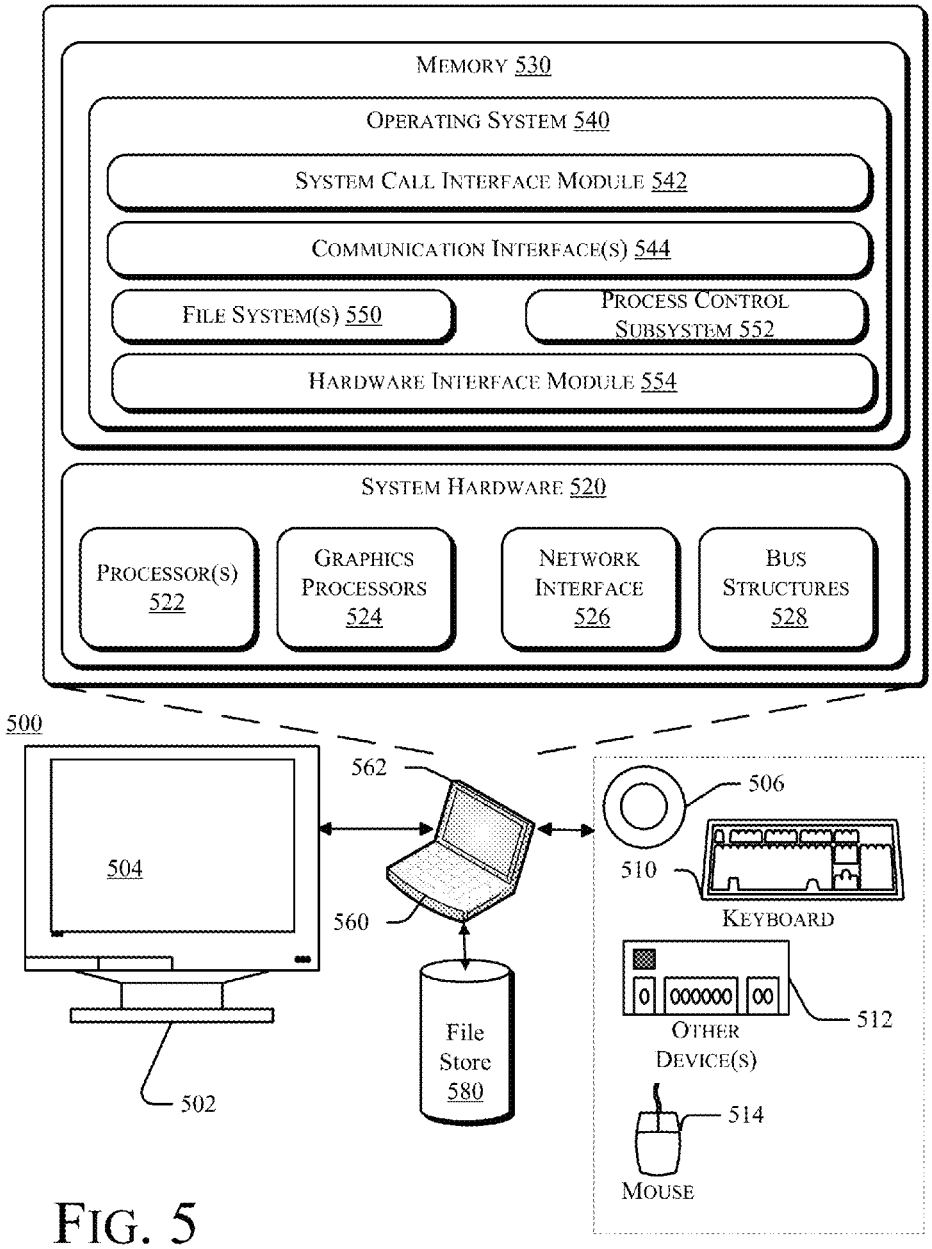
FIGS. 5-10 is a schematic illustration of an electronic device which may be adapted to include a blower, according to an embodiment.

In some embodiments a blower system such as that depicted in FIGS. 2A-2B and 3A-3B may be used in an electronic device such as in an ultrathin notebook to provide enhanced cooling capability compared to traditional cooling methods that rely on centrifugal blowers that require inlet gaps above and/or below the blower in order to draw air through the notebook. FIG. 5 is a schematic illustration of an exemplary electronic device 500 in accordance with some embodiments. In one embodiment, electronic device 500 may include one or more accompanying input/output devices such as one or more speakers 506, a keyboard 510, one or more other I/O device(s) 512, and a mouse 514. The other I/O device(s) 512 may include a touch screen, a voice-activated input device, a track ball, and any other device that allows the electronic device 500 to receive input from a user.

In various embodiments, the electronic device 500 may be embodied as a personal computer, a laptop computer, a personal digital assistant, a mobile telephone, an entertainment device, or another computing device. The electronic device 500 includes system hardware 520 and memory 530, which may be implemented as random access memory and/or read-only memory. A file store 580 may be communicatively coupled to electronic device 500. File store 580 may be internal to computing device 508 such as, e.g., one or more hard drives, CD-ROM drives, DVD-ROM drives, or other types of storage devices. File store 580 may also be external to computer 108 such as, e.g., one or more external hard drives, network attached storage, or a separate storage network.

System hardware 520 may include one or more processors 522, graphics processors 524, network interfaces 526, and bus structures 528. In one embodiment, processor 522 may be embodied as an Intel® Core2 Duo® processor available from Intel Corporation, Santa Clara, Calif., USA. As used herein, the term "processor" means any type of computational element, such as but not limited to, a microprocessor, a microcontroller, a complex instruction set computing (CISC) microprocessor, a reduced instruction set (RISC) microprocessor, a very long instruction word (VLIW) microprocessor, or any other type of processor or processing circuit.

In some embodiments one of the processors 522 in system hardware 520 may comprise a low-power embedded processor, referred to herein as a manageability engine (ME). The manageability engine 522 may be implemented as an independent integrated circuit or may be a dedicated portion of a larger processor 522.

Graphics processor(s) 524 may function as adjunct processor that manages graphics and/or video operations. Graphics processor(s) 524 may be integrated onto the motherboard of computing system 500 or may be coupled via an expansion slot on the motherboard.

In one embodiment, network interface 526 could be a wired interface such as an Ethernet interface (see, e.g., Institute of Electrical and Electronics Engineers/IEEE 802.3-2002) or a wireless interface such as an IEEE 802.11a, b or g-compliant interface (see, e.g., IEEE Standard for IT-Telecommunications and information exchange between systems LAN/MAN—Part II: Wireless LAN Medium Access Control (MAC) and Physical Layer (PHY) specifications Amendment 4: Further Higher Data Rate Extension in the 2.4 GHz Band, 802.11G-2003). Another example of a wireless interface would be a general packet radio service (GPRS) interface (see, e.g., Guidelines on GPRS Handset Requirements, Global System for Mobile Communications/GSM Association, Ver. 3.0.1, December 2002).

Bus structures 528 connect various components of system hardware 528. In one embodiment, bus structures 528 may be one or more of several types of bus structure(s) including a memory bus, a peripheral bus or external bus, and/or a local bus using any variety of available bus architectures including, but not limited to, 11-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

Memory 530 may include an operating system 540 for managing operations of computing device 508. In one embodiment, operating system 540 includes a hardware interface module 554 that provides an interface to system hardware 520. In addition, operating system 540 may include a file system 550 that manages files used in the operation of electronic device 500 and a process control subsystem 552 that manages processes executing on electronic device 500.

Operating system 540 may include (or manage) one or more communication interfaces that may operate in conjunction with system hardware 520 to transceive data packets and/or data streams from a remote source. Operating system 540 may further include a system call interface module 542 that provides an interface between the operating system 540 and one or more application modules resident in memory 530. Operating system 540 may be embodied as a UNIX operating system or any derivative thereof (e.g., Linux, Solaris, etc.) or as a Windows® brand operating system, or other operating systems.

In one embodiment, electronic device 500, comprises a clamshell body which includes a first section 560, commonly referred to as a base, which houses a keyboard, a motherboard, and other components, and a second section 562 which houses a display. The first section 560 and the second section 562 are connected by a hinge assembly which enables the clamshell body to open and close.

Figure 6:
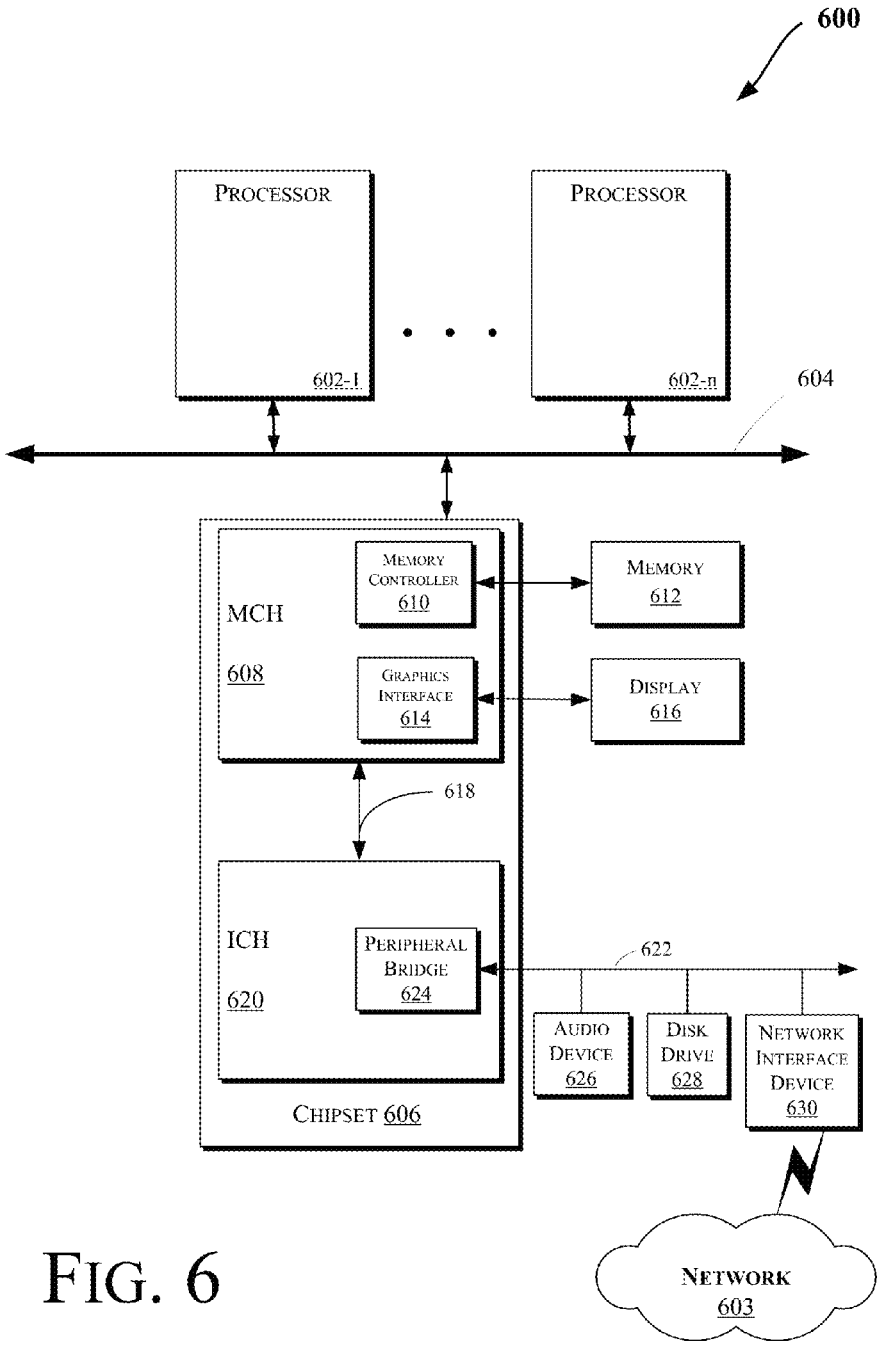

As described above, in some embodiments the electronic device may be embodied as a computer system. FIG. 6 illustrates a block diagram of a computing system 600 in accordance with an embodiment of the invention. The computing system 600 may include one or more central processing unit(s) (CPUs) 602 or processors that communicate via an interconnection network (or bus) 604. The processors 602 may include a general purpose processor, a network processor (that processes data communicated over a computer network 603), or other types of a processor (including a reduced instruction set computer (RISC) processor or a complex instruction set computer (CISC)). Moreover, the processors 602 may have a single or multiple core design. The processors 602 with a multiple core design may integrate different types of processor cores on the same integrated circuit (IC) die. Also, the processors 602 with a multiple core design may be implemented as symmetrical or asymmetrical multiprocessors. In an embodiment, one or more of the processors 602 may be the same or similar to the processors 102 of FIG. 1. For example, one or more of the processors 602 may include the control unit 120 discussed with reference to FIGS. 1-3.

Also, the operations discussed with reference to FIGS. 3-5 may be performed by one or more components of the system 600.

A chipset 606 may also communicate with the interconnection network 604. The chipset 606 may include a memory control hub (MCH) 608. The MCH 608 may include a memory controller 610 that communicates with a memory 612 (which may be the same or similar to the memory 130 of FIG. 1). The memory 412 may store data, including sequences of instructions, that may be executed by the CPU 602, or any other device included in the computing system 600. In one embodiment of the invention, the memory 612 may include one or more volatile storage (or memory) devices such as random access memory (RAM), dynamic RAM (DRAM), synchronous DRAM (SDRAM), static RAM (SRAM), or other types of storage devices. Nonvolatile memory may also be utilized such as a hard disk. Additional devices may communicate via the interconnection network 604, such as multiple CPUs and/or multiple system memories.

The MCH 608 may also include a graphics interface 614 that communicates with a display device 616. In one embodiment of the invention, the graphics interface 614 may communicate with the display device 616 via an accelerated graphics port (AGP). In an embodiment of the invention, the display 616 (such as a flat panel display) may communicate with the graphics interface 614 through, for example, a signal converter that translates a digital representation of an image stored in a storage device such as video memory or system memory into display signals that are interpreted and displayed by the display 616. The display signals produced by the display device may pass through various control devices before being interpreted by and subsequently displayed on the display 616.

A hub interface 618 may allow the MCH 608 and an input/output control hub (ICH) 620 to communicate. The ICH 620 may provide an interface to I/O device(s) that communicate with the computing system 600. The ICH 620 may communicate with a bus 622 through a peripheral bridge (or controller) 624, such as a peripheral component interconnect (PCI) bridge, a universal serial bus (USB) controller, or other types of peripheral bridges or controllers. The bridge 624 may provide a data path between the CPU 602 and peripheral devices. Other types of topologies may be utilized. Also, multiple buses may communicate with the ICH 620, e.g., through multiple bridges or controllers. Moreover, other peripherals in communication with the ICH 620 may include, in various embodiments of the invention, integrated drive electronics (IDE) or small computer system interface (SCSI) hard drive(s), USB port(s), a keyboard, a mouse, parallel port(s), serial port(s), floppy disk drive(s), digital output support (e.g., digital video interface (DVI)), or other devices.

The bus 622 may communicate with an audio device 626, one or more disk drive(s) 628, and a network interface device 630 (which is in communication with the computer network 603). Other devices may communicate via the bus 622. Also, various components (such as the network interface device 630) may communicate with the MCH 608 in some embodiments of the invention. In addition, the processor 602 and one or more other components discussed herein may be combined to form a single chip (e.g., to provide a System on Chip (SOC)). Furthermore, the graphics accelerator 616 may be included within the MCH 608 in other embodiments of the invention.

Furthermore, the computing system 600 may include volatile and/or nonvolatile memory (or storage). For example, nonvolatile memory may include one or more of the following: read-only memory (ROM), programmable ROM (PROM), erasable PROM (EPROM), electrically EPROM (EEPROM), a disk drive (e.g., 628), a floppy disk, a compact disk ROM (CD-ROM), a digital versatile disk (DVD), flash memory, a magneto-optical disk, or other types of nonvolatile machine-readable media that are capable of storing electronic data (e.g., including instructions).

Figure 7:
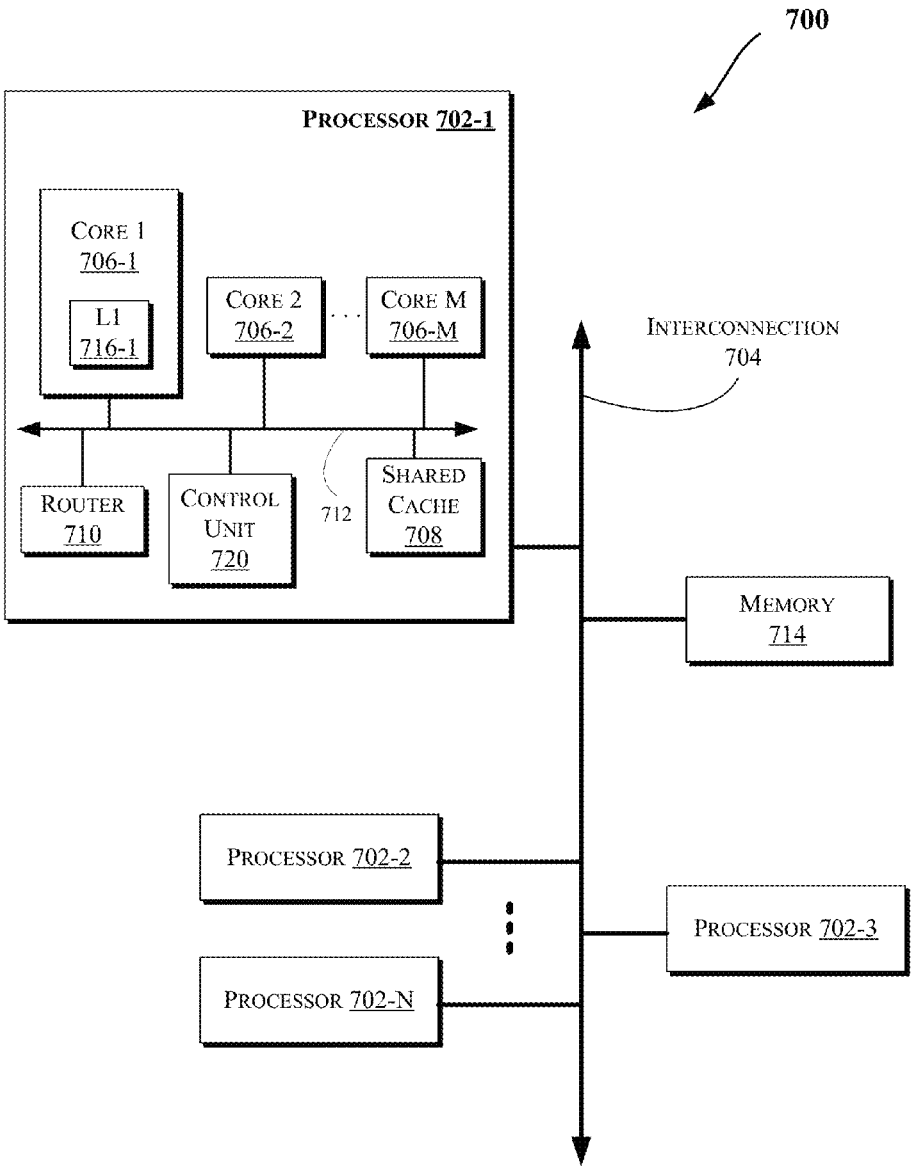

FIG. 7 illustrates a block diagram of a computing system 700, according to an embodiment of the invention. The system 700 may include one or more processors 702-1 through 702-N (generally referred to herein as "processors 702" or "processor 702"). The processors 702 may communicate via an interconnection network or bus 704. Each processor may include various components some of which are only discussed with reference to processor 702-1 for clarity. Accordingly, each of the remaining processors 702-2 through 702-N may include the same or similar components discussed with reference to the processor 702-1.

In an embodiment, the processor 702-1 may include one or more processor cores 706-1 through 706-M (referred to herein as "cores 706" or more generally as "core 706"), a shared cache 708, a router 710, and/or a processor control logic or unit 720. The processor cores 706 may be implemented on a single integrated circuit (IC) chip. Moreover, the chip may include one or more shared and/or private caches (such as cache 708), buses or interconnections (such as a bus or interconnection network 712), memory controllers, or other components.

In one embodiment, the router 710 may be used to communicate between various components of the processor 702-1 and/or system 700. Moreover, the processor 702-1 may include more than one router 710. Furthermore, the multitude of routers 710 may be in communication to enable data routing between various components inside or outside of the processor 702-1.

The shared cache 708 may store data (e.g., including instructions) that are utilized by one or more components of the processor 702-1, such as the cores 706. For example, the shared cache 708 may locally cache data stored in a memory 714 for faster access by components of the processor 702. In an embodiment, the cache 708 may include a mid-level cache (such as a level 2 (L2), a level 3 (L3), a level 4 (L4), or other levels of cache), a last level cache (LLC), and/or combinations thereof. Moreover, various components of the processor 702-1 may communicate with the shared cache 708 directly, through a bus (e.g., the bus 712), and/or a memory controller or hub. As shown in FIG. 7, in some embodiments, one or more of the cores 706 may include a level 1 (L1) cache 716-1 (generally referred to herein as "L1 cache 716"). In one embodiment, the control unit 720 may include logic to implement the operations described above with reference to the memory controller 122 in FIG. 2.

Figure 8:
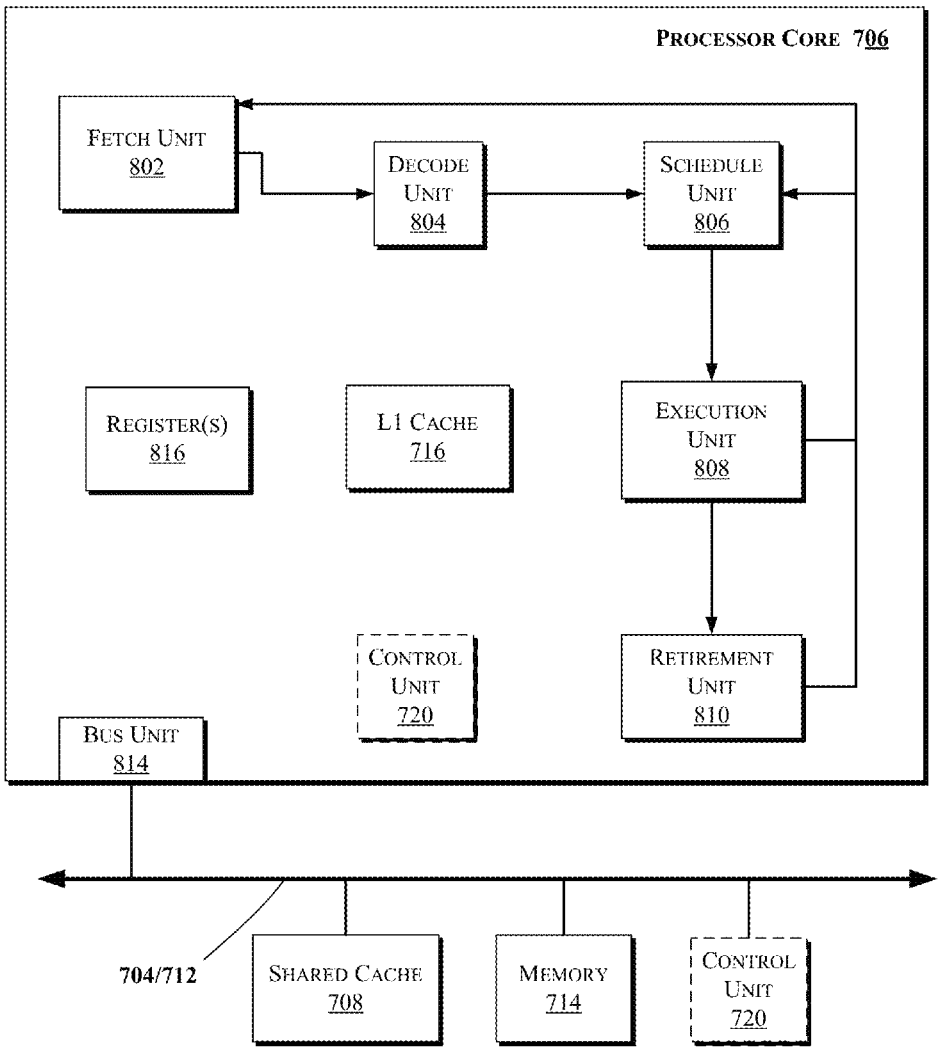

FIG. 8 illustrates a block diagram of portions of a processor core 706 and other components of a computing system, according to an embodiment of the invention. In one embodiment, the arrows shown in FIG. 8 illustrate the flow direction of instructions through the core 706. One or more processor cores (such as the processor core 706) may be implemented on a single integrated circuit chip (or die) such as discussed with reference to FIG. 7. Moreover, the chip may include one or more shared and/or private caches (e.g., cache 708 of FIG. 7), interconnections (e.g., interconnections 704 and/or 112 of FIG. 7), control units, memory controllers, or other components.

As illustrated in FIG. 8, the processor core 706 may include a fetch unit 802 to fetch instructions (including instructions with conditional branches) for execution by the core 706. The instructions may be fetched from any storage devices such as the memory 714. The core 706 may also include a decode unit 804 to decode the fetched instruction. For instance, the decode unit 804 may decode the fetched instruction into a plurality of uops (micro-operations).

Additionally, the core 706 may include a schedule unit 806. The schedule unit 806 may perform various operations associated with storing decoded instructions (e.g., received from the decode unit 804) until the instructions are ready for dispatch, e.g., until all source values of a decoded instruction become available. In one embodiment, the schedule unit 806 may schedule and/or issue (or dispatch) decoded instructions to an execution unit 808 for execution. The execution unit 808 may execute the dispatched instructions after they are decoded (e.g., by the decode unit 804) and dispatched (e.g., by the schedule unit 806). In an embodiment, the execution unit 808 may include more than one execution unit. The execution unit 808 may also perform various arithmetic operations such as addition, subtraction, multiplication, and/or division, and may include one or more an arithmetic logic units (ALUs). In an embodiment, a co-processor (not shown) may perform various arithmetic operations in conjunction with the execution unit 808.

Further, the execution unit 808 may execute instructions out-of-order. Hence, the processor core 706 may be an out-of-order processor core in one embodiment. The core 706 may also include a retirement unit 810. The retirement unit 810 may retire executed instructions after they are committed. In an embodiment, retirement of the executed instructions may result in processor state being committed from the execution of the instructions, physical registers used by the instructions being de-allocated, etc.

The core 706 may also include a bus unit 714 to enable communication between components of the processor core 706 and other components (such as the components discussed with reference to FIG. 8) via one or more buses (e.g., buses 804 and/or 812). The core 706 may also include one or more registers 816 to store data accessed by various components of the core 706 (such as values related to power consumption state settings).

Furthermore, even though FIG. 7 illustrates the control unit 720 to be coupled to the core 706 via interconnect 812, in various embodiments the control unit 720 may be located elsewhere such as inside the core 706, coupled to the core via bus 704, etc.

Figure 9:
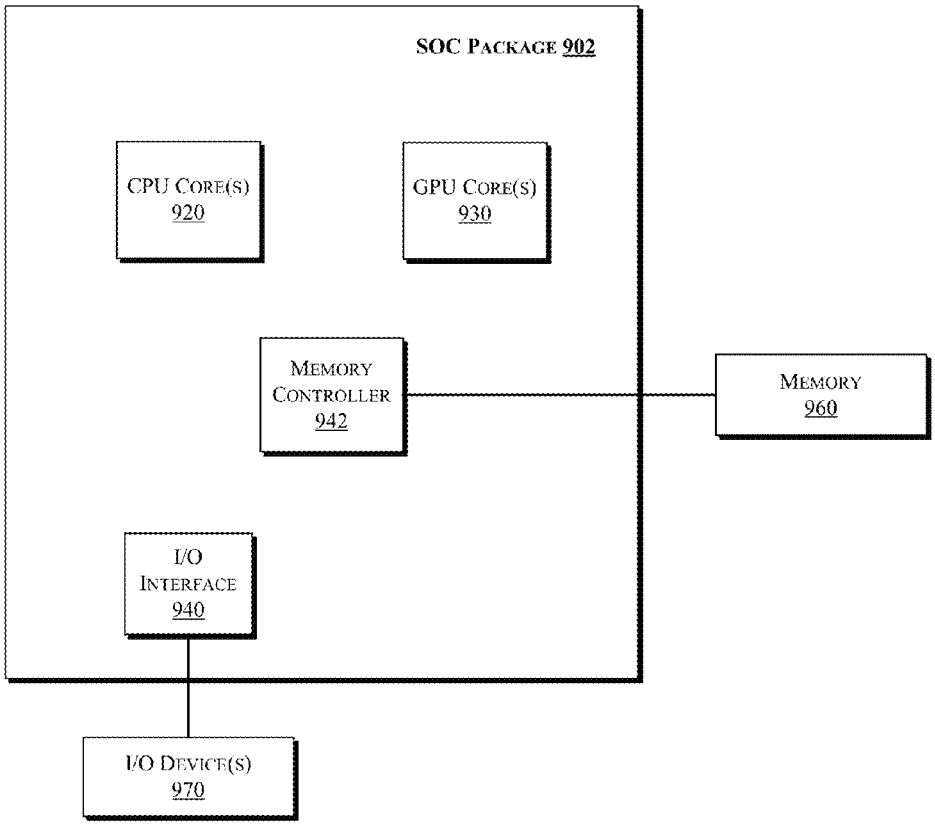

In some embodiments, one or more of the components discussed herein can be embodied as a System On Chip (SOC) device. FIG. 9 illustrates a block diagram of an SOC package in accordance with an embodiment. As illustrated in FIG. 9, SOC 902 includes one or more Central Processing Unit (CPU) cores 920, one or more Graphics Processor Unit (GPU) cores 930, an Input/Output (I/O) interface 940, and a memory controller 942. Various components of the SOC package 902 may be coupled to an interconnect or bus such as discussed herein with reference to the other figures. Also, the SOC package 902 may include more or less components, such as those discussed herein with reference to the other figures. Further, each component of the SOC package 902 may include one or more other components, e.g., as discussed with reference to the other figures herein. In one embodiment, SOC package 902 (and its components) is provided on one or more Integrated Circuit (IC) die, e.g., which are packaged into a single semiconductor device.

As illustrated in FIG. 9, SOC package 902 is coupled to a memory 960 (which may be similar to or the same as memory discussed herein with reference to the other figures) via the memory controller 942. In an embodiment, the memory 960 (or a portion of it) can be integrated on the SOC package 902.

The I/O interface 940 may be coupled to one or more I/O devices 970, e.g., via an interconnect and/or bus such as discussed herein with reference to other figures. I/O device(s) 970 may include one or more of a keyboard, a mouse, a touchpad, a display, an image/video capture device (such as a camera or camcorder/video recorder), a touch screen, a speaker, or the like.

Figure 10:
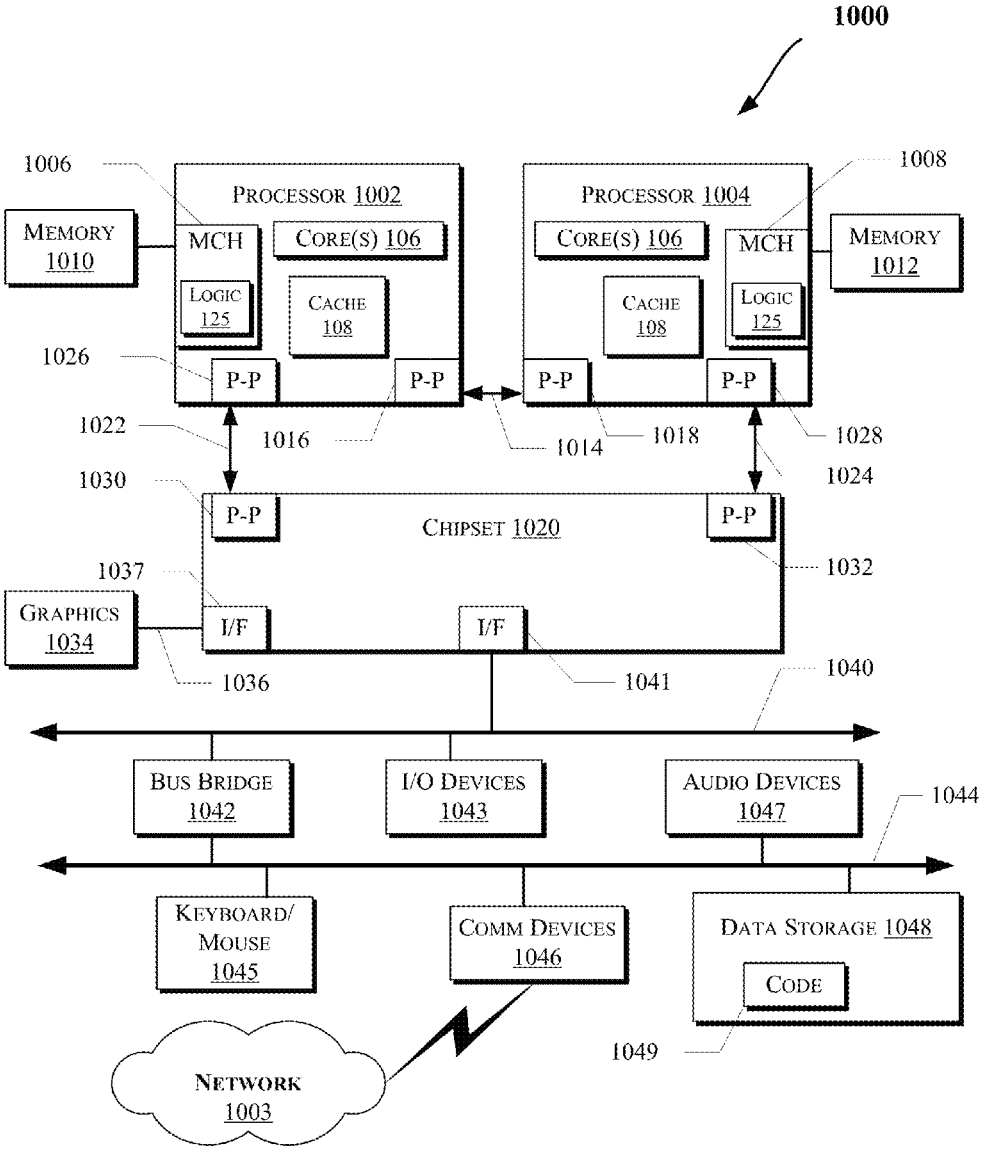

FIG. 10 illustrates a computing system 1000 that is arranged in a point-to-point (PtP) configuration, according to an embodiment of the invention. In particular, FIG. 10 shows a system where processors, memory, and input/output devices are interconnected by a number of point-to-point interfaces.

As illustrated in FIG. 10, the system 1000 may include several processors, of which only two, processors 1002 and 1004 are shown for clarity. The processors 1002 and 1004 may each include a local memory controller hub (MCH) 1006 and 1008 to enable communication with memories 1010 and 1012. MCH 1006 and 1008 may include the memory controller 120 and/or logic 125 of FIG. 1 in some embodiments.

In an embodiment, the processors 1002 and 1004 may be one of the processors 702 discussed with reference to FIG. 7. The processors 1002 and 1004 may exchange data via a point-to-point (PtP) interface 1014 using PtP interface circuits 1016 and 1018, respectively. Also, the processors 1002 and 1004 may each exchange data with a chipset 1020 via individual PtP interfaces 1022 and 1024 using point-to-point interface circuits 1026, 1028, 1030, and 1032. The chipset 1020 may further exchange data with a high-performance graphics circuit 1034 via a high-performance graphics interface 1036, e.g., using a PtP interface circuit 1037.

As shown in FIG. 10, one or more of the cores 106 and/or cache 108 of FIG. 1 may be located within the processors 1004. Other embodiments of the invention, however, may exist in other circuits, logic units, or devices within the system 1000 of FIG. 10. Furthermore, other embodiments of the invention may be distributed throughout several circuits, logic units, or devices illustrated in FIG. 10.

The chipset 1020 may communicate with a bus 1040 using a PtP interface circuit 1041. The bus 1040 may have one or more devices that communicate with it, such as a bus bridge 1042 and I/O devices 1043. Via a bus 1044, the bus bridge 1043 may communicate with other devices such as a keyboard/mouse 1045, communication devices 1046 (such as modems, network interface devices, or other communication devices that may communicate with the computer network 1003), audio I/O device, and/or a data storage device 1048. The data storage device 1048 (which may be a hard disk drive or a NAND flash based solid state drive) may store code 1049 that may be executed by the processors 1004.

The following examples pertain to further embodiments.

Example 1 is a blower, comprising a case comprising a first surface, a second surface opposite the first surface, and a side wall extending between portions of the first surface and the second surface, wherein the side wall comprises an air inlet and an air outlet, an impeller disposed in the case and rotatable about an axis of rotation extending through a hub, wherein the impeller comprises a plurality of blades which define a gap with the hub. wherein portions of the side wall are disposed at least a first distance from the axis of rotation and the impeller is to define a circumferential airflow path within the case, wherein the impeller is to create an airflow in the circumferential airflow path between the air inlet and the air outlet and a feature disposed in the gap to impede recirculation of air in the case.

In Example 2, the subject matter of claim 1 can optionally include an arcuate member disposed within portions of the gap.

In Example 3, the subject matter of any one of Examples 1-2 can optionally include a feature formed integrally with at least one of the first surface or the second surface.

In Example 4, the subject matter of any one of Examples 1-3 can optionally include impeller blades formed from at least one of a rigid material or a porous foam.

In Example 5, the subject matter of any one of Examples 1-4 can optionally include a gap which has an inner diameter disposed at a distance that measures between 40 millimeters and 55 millimeters from the axis of rotation and an outer diameter that measures between 45 millimeters and 60 millimeters from the axis of rotation.

In Example 6, the subject matter of any one of Examples 1-6 can optionally an impeller which is centrally located within the case.

In Example 7, the subject matter of any one of Examples 1-6 can optionally include a motor coupled to the impeller to rotate the impeller about the axis of rotation.

Example 8 is a housing for an electronic device comprising a first section and a second section coupled to the first section to define an internal chamber, a motor disposed in the internal chamber, and a blower coupled to the motor, the blower comprising a case comprising a first surface, a second surface opposite the first surface, and a side wall extending between portions of the first surface and the second surface, wherein the side wall comprises an air inlet and an air outlet, an impeller disposed in the case and rotatable about an axis of rotation extending through a hub, wherein the impeller comprises a plurality of blades which define a gap with the hub, wherein portions of the side wall are disposed at least a first distance from the axis of rotation and the impeller is to define a circumferential airflow path within the case, wherein the impeller is to create an airflow in the circumferential airflow path between the air inlet and the air outlet and a feature disposed in the gap to impede recirculation of air in the case.

In Example 9, the subject matter of claim 8 can optionally include an arcuate member disposed within portions of the gap.

In Example 10, the subject matter of any one of Examples 8-9 can optionally include a feature formed integrally with at least one of the first surface or the second surface.

In Example 11, the subject matter of any one of Examples 8-10 can optionally include impeller blades formed from at least one of a rigid material or a porous foam.

In Example 12, the subject matter of any one of Examples 8-11 can optionally include a gap which has an inner diameter disposed at a distance that measures between 40 millimeters and 55 millimeters from the axis of rotation and an outer diameter that measures between 45 millimeters and 60 millimeters from the axis of rotation.

In Example 13, the subject matter of any one of Examples 8-12 can optionally an impeller which is centrally located within the case.

In Example 14, the subject matter of any one of Examples 8-13 can optionally include a motor coupled to the impeller to rotate the impeller about the axis of rotation.

Example 15 is an electronic device comprising a housing, comprising a first section and a second section coupled to the first section to define an internal chamber, at least one heat producing dissipation disposed in the internal chamber, a motor disposed in the internal chamber and a blower coupled to the motor, the blower comprising a case comprising a first surface, a second surface opposite the first surface, and a side wall extending between portions of the first surface and the second surface, wherein the side wall comprises an air inlet and an air outlet, an impeller disposed in the case and rotatable about an axis of rotation extending through a hub, wherein the impeller comprises a plurality of blades which define a gap with the hub, wherein portions of the side wall are disposed at least a first distance from the axis of rotation and the impeller is to define a circumferential airflow path within the case, wherein the impeller is to create an airflow in the circumferential airflow path between the air inlet and the air outlet, and a feature disposed in the gap to impede recirculation of air in the case.

In Example 16, the subject matter of claim 15 can optionally include an arcuate member disposed within portions of the gap.

In Example 17, the subject matter of any one of Examples 15-16 can optionally include a feature formed integrally with at least one of the first surface or the second surface.

In Example 18, the subject matter of any one of Examples 15-17 can optionally include impeller blades formed from at least one of a rigid material or a porous foam.

In Example 19, the subject matter of any one of Examples 15-18 can optionally include a gap which has an inner diameter disposed at a distance that measures between 40 millimeters and 55 millimeters from the axis of rotation and an outer diameter that measures between 45 millimeters and 60 millimeters from the axis of rotation.

In Example 20, the subject matter of any one of Examples 15-19 can optionally an impeller which is centrally located within the case.

In Example 21, the subject matter of any one of Examples 15-20 can optionally include a motor coupled to the impeller to rotate the impeller about the axis of rotation.

The terms "logic instructions" as referred to herein relates to expressions which may be understood by one or more machines for performing one or more logical operations. For example, logic instructions may comprise instructions which are interpretable by a processor compiler for executing one or more operations on one or more data objects. However, this is merely an example of machine-readable instructions and embodiments are not limited in this respect.

The terms "computer readable medium" as referred to herein relates to media capable of maintaining expressions which are perceivable by one or more machines. For example, a computer readable medium may comprise one or more storage devices for storing computer readable instructions or data. Such storage devices may comprise storage media such as, for example, optical, magnetic or semiconductor storage media. However, this is merely an example of a computer readable medium and embodiments are not limited in this respect.

The term "logic" as referred to herein relates to structure for performing one or more logical operations. For example, logic may comprise circuitry which provides one or more output signals based upon one or more input signals. Such circuitry may comprise a finite state machine which receives a digital input and provides a digital output, or circuitry which provides one or more analog output signals in response to one or more analog input signals. Such circuitry may be provided in an application specific integrated circuit (ASIC) or field programmable gate array (FPGA). Also, logic may comprise machine-readable instructions stored in a memory in combination with processing circuitry to execute such machine-readable instructions. However, these are merely examples of structures which may provide logic and embodiments are not limited in this respect.

Some of the methods described herein may be embodied as logic instructions on a computer-readable medium. When executed on a processor, the logic instructions cause a processor to be programmed as a special-purpose machine that implements the described methods. The processor, when configured by the logic instructions to execute the methods described herein, constitutes structure for performing the described methods. Alternatively, the methods described herein may be reduced to logic on, e.g., a field programmable gate array (FPGA), an application specific integrated circuit (ASIC) or the like.

In the description and claims, the terms coupled and connected, along with their derivatives, may be used. In particular embodiments, connected may be used to indicate that two or more elements are in direct physical or electrical contact with each other. Coupled may mean that two or more elements are in direct physical or electrical contact. However, coupled may also mean that two or more elements may not be in direct contact with each other, but yet may still cooperate or interact with each other.

Reference in the specification to "one embodiment" or "some embodiments" means that a particular feature, structure, or characteristic described in connection with the embodiment is included in at least an implementation. The appearances of the phrase "in one embodiment" in various places in the specification may or may not be all referring to the same embodiment.

Although embodiments have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. A blower, comprising:

a case comprising a first surface, a second surface opposite the first surface, and a side wall extending between portions of the first surface and the second surface, wherein the side wall comprises an air inlet and an air outlet;

an impeller disposed in the case and rotatable about an axis of rotation extending through a hub, wherein the impeller comprises a plurality of blades which define a gap with the hub;

wherein portions of the side wall are disposed at least a first distance from the axis of rotation and the impeller is to define a circumferential airflow path within the case;

wherein the impeller is to create an airflow in the circumferential airflow path between the air inlet and the air outlet; and a feature disposed in the gap to impede recirculation of air in the case.

2. The blower of claim 1, wherein:

the feature comprises an arcuate member disposed within portions of the gap.

3. The blower of claim 1, wherein the feature is formed integrally with at least one of the first surface or the second surface.

4. The blower of claim 1, wherein:

the impeller blades are formed from at least one of a rigid material or a porous foam.

5. The blower of claim 1, wherein:

the gap has an inner diameter disposed at a distance that measures between 40 millimeters and 55 millimeters from the axis of rotation and an outer diameter that measures between 45 millimeters and 60 millimeters from the axis of rotation.

6. The blower of claim 1, wherein the impeller is centrally located within the case.

7. The blower of claim 1, further comprising a motor coupled to the impeller to rotate the impeller about the axis of rotation.

8. A housing for an electronic device, comprising:

a first section and a second section coupled to the first section to define an internal chamber;

a motor disposed in the internal chamber; and a blower coupled to the motor, the blower comprising:

a case comprising a first surface, a second surface opposite the first surface, and a side wall extending between portions of the first surface and the second surface, wherein the side wall comprises an air inlet and an air outlet;

an impeller disposed in the case and rotatable about an axis of rotation extending through a hub, wherein the impeller comprises a plurality of blades which define a gap with the hub;

wherein portions of the side wall are disposed at least a first distance from the axis of rotation and the impeller is to define a circumferential airflow path within the case;

wherein the impeller is to create an airflow in the circumferential airflow path between the air inlet and the air outlet; and a feature disposed in the gap to impede recirculation of air in the case.

9. The housing of claim 8, wherein:

the feature comprises an arcuate member disposed within portions of the gap.

10. The housing of claim 9, wherein the impeller is centrally located within the case.

11. The housing of claim 9, further comprising a heat exchanger disposed proximate the air outlet.

12. The housing of claim 8, wherein the feature is formed integrally with at least one of the first surface or the second surface.

13. The housing of claim 8, wherein:

the impeller blades are formed from at least one of a rigid material or a porous foam.

14. The housing of claim 8, wherein:

the gap measures has an inner diameter disposed at a distance that measures between 15 millimeters and 25 millimeters from the axis of rotation and an outer diameter that measures between 30 millimeters and 38 millimeters from the axis of rotation.

15. An electronic device, comprising:

a housing, comprising:

a first section and a second section coupled to the first section to define an internal chamber;

at least one heat producing dissipation disposed in the internal chamber;

a motor disposed in the internal chamber; and a blower coupled to the motor, the blower comprising:

a case comprising a first surface, a second surface opposite the first surface, and a side wall extending between portions of the first surface and the second surface, wherein the side wall comprises an air inlet and an air outlet;

an impeller disposed in the case and rotatable about an axis of rotation extending through a hub, wherein the impeller comprises a plurality of blades which define a gap with the hub;

wherein portions of the side wall are disposed at least a first distance from the axis of rotation and the impeller is to define a circumferential airflow path within the case;

wherein the impeller is to create an airflow in the circumferential airflow path between the air inlet and the air outlet; and a feature disposed in the gap to impede recirculation of air in the case.

16. The electronic device of claim 15, wherein:

the feature comprises an arcuate member disposed within portions of the gap.

17. The electronic device of claim 16, wherein the impeller is centrally located within the case.

18. The electronic device of claim 16, further comprising a heat exchanger disposed proximate the air outlet.

19. The electronic device of claim 15, wherein the feature is formed integrally with at least one of the first surface or the second surface.

20. The electronic device of claim 15, wherein:

the impeller blades are formed from at least one of a rigid material or a porous foam.

21. The electronic device of claim 15, wherein:

the gap measures has an inner diameter disposed at a distance that measures between 15 millimeters and 25 millimeters from the axis of rotation and an outer diameter that measures between 30 millimeters and 38 millimeters from the axis of rotation.

* * * * *